US005981622A

United States Patent [19]

Geoffrey

[11] Patent Number: 5,981,622

[45] Date of Patent: Nov. 9, 1999

[54] FOUNDRY BINDER OF POLYURETHANE, PHENOLIC RESIN, POLYISOCYANATE AND EPOXY RESIN

[75] Inventor: Michael M. Geoffrey, Lombard, Ill.

[73] Assignee: Borden Chemical, Inc., Columbus, Ohio

[21] Appl. No.: 08/980,202

[22] Filed: Nov. 28, 1997

Related U.S. Application Data

[62] Division of application No. 08/544,865, Oct. 18, 1995, Pat. No. 5,733,952.

[51] Int. Cl.[6] ..... B22C 1/22; C08K 5/01; C08L 61/10

[52] U.S. Cl. ..... 523/143; 523/455; 523/463

[58] Field of Search ..... 523/143, 455, 523/463

[56] References Cited

U.S. PATENT DOCUMENTS

| | | | |
|---|---|---|---|
| 2,449,928 | 9/1948 | Corkery . | |
| 3,442,974 | 5/1969 | Bremmer . | |
| 3,668,160 | 6/1972 | Horton et al. . | |
| 3,935,339 | 1/1976 | Cooke, Jr. | 427/216 |
| 4,113,916 | 9/1978 | Craig | 428/404 |
| 4,293,480 | 10/1981 | Martin et al. | 525/456 |
| 4,294,742 | 10/1981 | Rugen et al. . | |
| 4,415,469 | 11/1983 | Tsai | 525/528 |
| 4,546,124 | 10/1985 | Laitar et al. | 523/143 |
| 4,680,346 | 7/1987 | Carson et al. | 525/486 |
| 4,711,935 | 12/1987 | Gmoser et al. | 525/452 |
| 4,740,540 | 4/1988 | Kameda et al. | 523/457 |
| 5,189,079 | 2/1993 | Geoffrey et al. | 523/142 |
| 5,231,130 | 7/1993 | Wallon et al. | 524/500 |
| 5,286,765 | 2/1994 | Franke et al. | 523/142 |
| 5,489,646 | 2/1996 | Tatman et al. | 524/474 |

FOREIGN PATENT DOCUMENTS

| | | |
|---|---|---|
| 2305481 | 10/1976 | France . |
| 4303887 | 4/1994 | Germany . |
| 7-268051 | 10/1995 | Japan . |

*Primary Examiner*—Robert E. Sellers
*Attorney, Agent, or Firm*—Stevens, Davis, Miller & Mosher, L.L.P.

[57] ABSTRACT

Compositions and methods for improving the characteristics of foundry cores which includes adding to a foundry aggregate mixture polyurethane resin binder comprising epoxy resin and, preferably, paraffinic oil.

10 Claims, 1 Drawing Sheet

FOUNDRY BINDER OF POLYURETHANE, PHENOLIC RESIN, POLYISOCYANATE AND EPOXY RESIN

This is a division of application Ser. No. 08/544,865 filed Oct. 18, 1995, U.S. Pat. No. 5,733,952.

FIELD OF THE INVENTION

This invention relates to the use of epoxy resins and, optionally, paraffinic oils in urethane foundry binders. The urethane foundry binders which contain the epoxy resins and paraffinic oils are especially resistant to water-based coatings.

BACKGROUND OF THE INVENTION

Binders or binder systems for foundry cores and molds are well known. In the foundry art, cores or molds for making metal castings are normally prepared from a mixture of an aggregate material, such as sand, and a binding amount of a binder system. Typically, after the aggregate material and binder have been mixed, the resultant mixture is rammed, blown or otherwise formed to the desired shape or patterns, and then cured with the use of catalyst and/or heat to a solid, cured state.

In the foundry industry, the binder is typically from about 0.4 to about 6 percent by weight of the coated particle. Moreover, binder coated foundry particulates have a particle size in the range of USA Standard Testing screen numbers from 16 to about 270 (i.e., a screen opening of 0.0469 inch to 0.0021 inch).

Typically, the particulate substrates for foundry use are granular refractory aggregate Examples of refractory aggregates include silica sand, chromite sand, zircon sand, olivine sand and mixtures thereof. For purposes of the disclosure of the present invention such materials are referred to as "sand" or "foundry sand".

In the foundry art, cores or molds for making metal castings are normally prepared from a mixture of aggregate material, such as foundry sand, and a binding amount of a binder or binder system. A number of binders or binder systems for foundry cores and molds are known. Typically, after the aggregate material and binder have been mixed, the resulting mixture is rammed, blown or otherwise formed to the desired shape or pattern, and then cured to a solid, cured state. A variety of processes have been developed in the foundry industry for forming and curing molds and cores.

One popular foundry process is known as the Croning or C process (more commonly known as the shell process). In this process, foundry sand is coated with a thermoplastic resin, a crosslinker and optionally other additives. Thermoplastic resin can be in solid form or in solution with a volatile organic solvent or mixtures of solvent and water. If the thermoplastic resin is a solid, the coating process requires the sand be heated to temperatures above the resin's melting point. Then the resin, crosslinker and other additives are coated evenly on the foundry sand to give a curable coating composition.

If the resin is in a solution, sand can be coated at temperatures at which the solvent can be readily removed. This process is also referred to as the liquid shell process. Frequently, crosslinker and additives are dissolved (or dispersed) in the solvent with the resin. The resinous mixture is added to warm sand. With agitation, the solvent is removed, leaving a curable coating on the sand particles. It is also possible to incorporate resin additives at other steps of the coating process.

In either case, a curable resin composition is coated onto the sand to form free flowing resin coated sand (particles). Subsequently, the resin coated sand is packed into a heated mold, usually at 350° to 750° F. to initiate curing of the thermoplastic polymer by reaction with the crosslinker to form thermosetting polymer. After the curing cycle, a shell of cured resin coated sand is formed adjacent to the heated surface. Depending upon the shape of the heated surfaces, shell molds and cores can be made and used in a foundry by this method.

Resin binders used in the production of foundry molds and cores are often cured at high temperatures, as discussed above, to achieve the fast-curing cycles required in foundries. However, in recent years, resin binders have been developed which cure at a low temperature, to avoid the need for high-temperature curing operations which have higher energy requirements and which often result in the production of undesirable fumes.

One group of processes which do not require heating to achieve curing of the resin binder are referred to as "cold-box" processes. In such processes, the binder components are coated on the aggregate material, such as sand, and the material is blown into a box of the desired shape. Curing of the binder is carried out by passing a gaseous catalyst at ambient temperatures through the molded resin-coated material. Where such processes use urethane binders, the binder components comprise a polyhydroxy component and a polyisocyanate component. These cure to form a polyurethane in the presence of a gaseous amine catalyst.

Another group of binder systems which do not require gassing or heating to bring out curing are known as "no-bake" systems. No-bake systems based on the use of urethane binders use an aggregate material, such as sand, coated with a polyhydroxy component and a polyisocyanate component. In this case, a liquid tertiary amine catalyst is combined with the polyhydroxy component at the time of mixing and the mixed aggregate and binder is allowed to cure in a pattern or core box at ambient or slightly higher temperatures.

As alluded to above, the binder for the urethane cold-box or no-bake systems is a two-part composition. Part one of the binder is a polyol (comprising preferably hydroxy containing phenol formaldehyde resin) and part two is an isocyanate (comprising preferably polyaryl polyisocyanates). Both parts are in a liquid form and are generally used in combination with organic solvents. To form the binder and thus, the foundry sand mixture, the polyol part and the isocyanate part are combined. After a uniform mixture of the boundary sand and parts one and two is achieved, the foundry mix is formed or shaped as desired. Parts one and/or two may contain additional components such as, for example, mold release agents, plasticizers, inhibitors, etc.

Liquid amine catalysts and metallic catalysts, known in the urethane technology, are employed in a no-bake composition. The catalyst may be incorporated into either part one or two of the system or it may be added after uniform mixing as a part three. Conditions of the core making process, for example, work time (assembling and admixing components and charging the admixture to a mold) and strip time (removing the molded core from the mold) can be adjusted by selection of a proper catalyst.

In cold-box technology, the curing step is accomplished by suspending a tertiary amine catalyst in an inert gas stream and passing the gas stream containing the tertiary amine, under sufficient pressure to penetrate the molded shape until the resin is cured.

Improvements in resinous binder systems which can be processed according to the cold-box or no-bake process generally arise by modifying the resin components, i.e., either the polyol part or the isocyanate part. For instance, U.S. Pat. No. 4,546,124, which is incorporated herein by reference, describes an alkoxy modified phenolic resin as the polyhydroxy component. The modified phenolic resin improves the hot strength of the binder systems. U.S. Pat. No. 5,189,079, which is herein incorporated by reference, discloses the use of a modified resole resin. These resins are desired because they emit reduced amounts of formaldehyde. U.S. Pat. No. 4,293,480, herein incorporated by reference, relates to improvements in the isocyanate component which enhances shake-out properties of non-ferrous castings.

Epoxy resins have been used in the formulation of phenolic foundry binders. For example, Plastiflake® 1114 and Plastiflake® 1119 novolac resins (which are not urethane resins) contain epoxy resins as plasticizers as disclosed by U.S. Pat. No. 4,113,916 to Craig, incorporated herein by reference. Kerosine, a mixture of aliphatic and aromatic hydrocarbon, has been employed in urethane binder formulations. Kerosine is a common solvent found in urethane binders. However, the known uses of kerosine in urethane do not include epoxy.

Water based coatings are often employed with resin coated foundry sand. The coatings are employed to make the mold or core more resistant to heat or to provide molds and cores having improved surface characteristics. However, the water based coatings can degrade the urethane coating on the foundry sand. It would be advantageous to provide an additive for urethane resins for foundry use which is highly resistant to water based coatings. Also, conventional urethane coatings and molds or cores lose strength during heating. It would be desirable to achieve improved resistance to losing strength during heating.

OBJECTS OF THE INVENTION

It is an object of the present invention to provide an improved urethane resin-containing binder system.

It is another object of the present invention to provide an improved urethane resin-containing binder system by substituting epoxy resin and/or paraffinic oil for a portion of conventionally used plasticizers or solvents.

It is another object of the present invention to provide a method for preparing an improved urethane resin—containing binder system.

These and other objects and advantages will be disclosed by the following description.

SUMMARY OF THE INVENTION

In accordance with this invention, improvements in cold-box and no-bake binder systems are obtained by employing epoxy resins and paraffinic oils in otherwise conventional urethane binder formulations. These new binders are especially resistant to water-based coatings and any subsequent drying that may occur at elevated temperatures. An unexpected synergy was discovered between the epoxy resins and the paraffinic oils in these binders. Improvements in tensile build, in addition to improvements in resistance to water-based coatings, were noted when the epoxy resins were used in combination with the paraffinic oils. These improvements were present but diminished when the epoxy resins or paraffinic oils were used separately. Organic esters (long-chain esters) and/or fatty acid ester blends promote incorporating the aliphatic paraffinic oils in the formulation. These esters are substituted with sufficiently large aliphatic groups to aid the incorporation, and may themselves aid the water resistance of the resulting formulation. However, the effect of these organic esters is distinguishable from the effect of the epoxy resins and paraffinic oils.

The present invention also includes methods of making such improved binders.

DETAILED DESCRIPTION OF THE INVENTION

Figure 1:
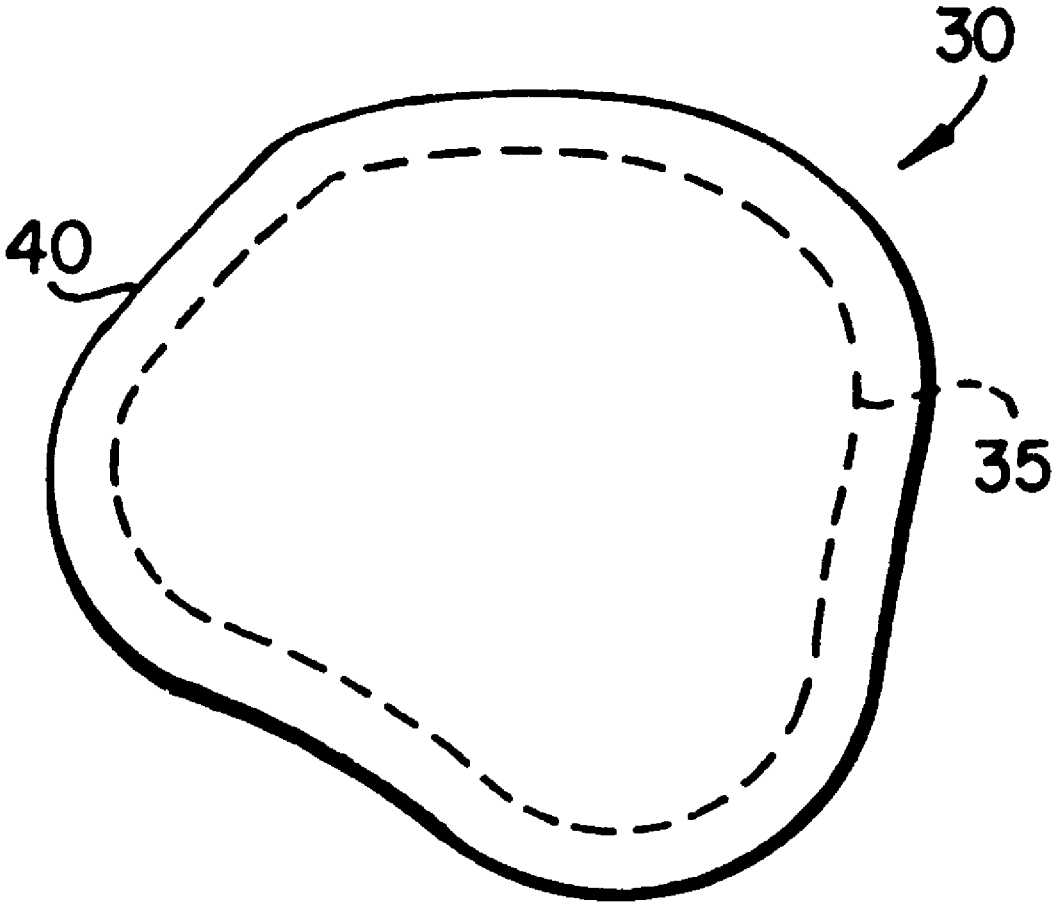
FIG. 1 shows coated particulate material for use in a foundry.

The binder of the present invention comprises a phenolic (part one) component and an isocyanate (part two) component selected from diisocyanates and polyisocyanates, and sufficient catalyst to catalyze the reaction between the phenolic resin component and the isocyanate component. Either or both of the phenolic and isocyanate components of the present invention contain paraffinic oil. The amounts of the phenolic component and the isocyanate component employed in a binder composition of the invention are not critical and can vary widely. However, there should at least be enough of the isocyanate component present to give adequate curing of the binder.

The isocyanate component is generally employed in a range of from about 15% to about 400% by weight, based on the weight of the phenolic component, and is preferably employed in a range of from about 20 to about 200%. Moreover, a liquid isocyanate can be used in undiluted form, so long as there is sufficient solvent employed with the phenolic component. Solid or viscous isocyanates can also be utilized and are generally used with an organic solvent. In this respect, the isocyanate component may include up to 80% by weight of solvent.

Furthermore, it is to be understood that in accordance with the invention, both the phenolic and isocyanate components are, as a practical matter, preferably dissolved in solvents to provide component solvent mixtures of desirable viscosity and thus, facilitate the use of the same, such as in coating aggregate material with the components.

Liquid amine catalysts and metallic catalysts employed in the no-bake process may be in either part one and/or part two or added to a mixture of parts one and two. In the cold-box process, tertiary amine catalysts are employed by being carried by an inert gas stream over a molded article until curing is accomplished.

The quantity of binder can vary over a broad range sufficient to bind the refractory on curing of the binder. Generally, such quantity will vary from about 0.4 to about 6 weight percent of binder based on the weight of particulate refractory and preferably about 0.5% to 3.0% by weight of the particulate refractory.

Solvents

As discussed above, both the polyhydroxy phenolic component (part one) and isocyanate component (part two) are typically dissolved in solvents. The solvents provide component solvent mixtures of desirable viscosity and facilitate coating foundry aggregates with part one and part two binder components. In this respect, sufficient solvents are employed to provide a Brookfield viscosity of solutions of part one and part two components below about 1000 centipoises and preferably less than 500 centipoises. More specifically, while the total amount of a solvent can vary widely, it is generally present in a composition of this invention in a range of from about 5% to about 70% by weight, based on total weight of the polyhydroxy phenolic component, and is preferably present in a range of from about 20% to about 60% by weight.

The solvents employed in the practice of this invention are generally mixtures of hydrocarbon and polar organic solvents such as organic esters.

Suitable exemplary hydrocarbon solvents include aromatic hydrocarbons such as benzene, toluene, xylene, ethyl benzene, high boiling aromatic hydrocarbon mixtures, heavy aromatic naphthas and the like.

Although the solvents employed in combination with either the polyhydroxy phenolic component or the isocyanate component do not, to any significant degree, enter into the reaction between parts one and two, they can affect the reaction. Thus, the difference in polarity between the isocyanate component and the polyol component restricts the choice of solvents (and plasticizers for that matter) in which both part one and part two components are compatible. Such compatibility is necessary to achieve complete reaction and curing of the binder composition.

Organic mono esters (long-chain esters), dibasic acid ester and/or fatty acid ester blends increase the polarity of the formulation and thus promote incorporating the aliphatic paraffinic oils in the more polar formulation. Preferably, the organic esters, etc. are in the isocyanate component. Long-chain esters, such as glyceryltrioleate, will facilitate the incorporation of paraffinic oil into a phenolic binder system. The aliphatic "tail" of the ester is compatible with the alkane structure of the oil, while the ester "head" of the ester is compatible with the polar components of the system. The use of a long-chain ester then allows a balancing of polar character which facilitates the incorporation of the oil into a more polar system. Also, it should be noted that the effect of the long-chain ester on resistance to water-based coatings is separable from the effect due to the combination of epoxy and paraffinic oil.

Alkylbiphenyl Compounds

A biphenyl compound or a mixture of biphenyl compounds, when used as an additive per se or as a substitute for a portion or part of the solvent/plasticizer system improves both the release characteristics and the hot strength of both cold box and no-bake systems and the humidity resistance of the cold box system. Humidity is a concern to the formulator because its effect is to reduce the tensile strength of produced cores. The presence of water or water vapor can react with any unreacted isocyanate, thus producing a weak, undesirable chemical structure. Also, the presence of water or water vapor can cause a drop in tensile strength of cured cores exposed to these conditions. The effect may even be insidious as other more easily measured parameters such as cure time, may not be influenced, thus providing the formulator with a false sense of security. Hundreds of cores may be produced before the affects of humidity become apparent. Accordingly, the ability to improve humidity resistance is a significant advance in the art. An improved hot strength allows for more uniform or better castings especially when dealing with hotter metal pours such as iron. These advantages are achieved without any significant negative effects.

The biphenyl compounds which call be used as part of or as substitutes for a portion of the solvent/plasticizer composition include a compound or mixtures of compounds represented by the following Formula I:

I

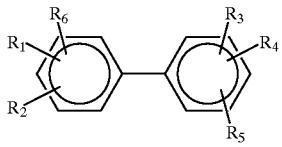

wherein $R_1$–$R_6$ which may be the same or different represent H, and $C_1$–$C_6$, preferably $C_1$–$C_4$, branched and unbranched alkyls and/or alkenyl substituents, with the proviso that when $R_1$–$R_6$ are each hydrogen (phenylbenzene), and when such a compound is present in contaminant or impure amounts, e.g., less than 1% by weight of the part 1 or part 2 component, it is used in combination with another substituted biphenyl as defined above or as defined below in Formula II.

More preferably the biphenyl substitute is a mixture of substituted lower alkyl ($C_1$–$C_6$) compounds. A preferred composition comprises a mixture of compounds having di- and tri- substitution sold by Koch Chemical Company of Corpus Christi, Tex., as SURE-SOL® 300, which is a mixture of diisopropylbiphenyl and triisopropylbiphenyl compounds. The mixture is composed of compounds represented by the following formulae:

II

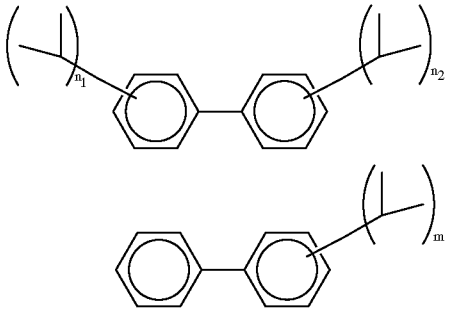

wherein $n_1$ and $n_2$ are equal to the number 1 or 2, as long as the sum of $n_1$ and $n_2$ is 2 or 3, and m is equal to the number 2 or 3, and for convenience the mixture is collectively referred to as Formula II.

Product information relating to SURE-SOL® 300 is listed on Table 1.

TABLE 1

| Characteristics | Test Method | Specifications Minimum | Maximum | Typical |
|---|---|---|---|---|
| Aromaticity, FIA, Wt. % | D-1319-77 | 98 | — | 98+ |
| Water, ppm | D-1744 | — | 150 | 75 |
| Total sulfur, ppm | D-3120 | — | 10 | 1 |
| Total chlorides, ppm | UOP-588 | — | 5 | <1 |
| $H_2S$ & $SO_2$ | D-853 | — | None | None |
| Acidity, mg KOH/g | D-847 | — | None | None |
| Spec. Gravity, 60/60° F. | D-287 | 0.94 | 0.97 | 0.955 |
| Color, ASTM | D-1500 | — | 0.5 | <0.5 |
| Refractive Index, 20° C. | D-1218 | — | — | 1.5615 |
| Distillation, ° F. | D-86 | | | |
| Initial Boiling Pt. | | 590 | — | 600 |
| End Point | | — | — | 650 |
| Flash Point, COC, ° F. | D-92 | 320 | — | 330 |
| Fire Point, COC, ° F. | D-92 | 360 | — | 380 |

TABLE 1-continued

| Characteristics | Test Method | Specifications Minimum | Maximum | Typical |
|---|---|---|---|---|
| Solvency | | | | |
| Mixed Aniline Pt. ° C. | D-611 | — | — | 16.4 |
| Kauri-Butanol | D-1133 | — | — | 59.7 |
| Flow Properties | | | | |
| Freeze Point, ° F. | D-1015 | — | — | −26 |
| Pour Point, ° F. | D-97 | — | 0 | −20 |
| Kinematic Viscosity, cst. @ 100° F. | D-445 | — | 16.0 | 15.0 |
| Kinematic Viscosity, cst. @ 210° F. | D-445 | — | — | 2.7 |

The biphenyl component, which may include one or more biphenyl compounds, can be used in amounts as high as 80% by weight of a part one or part two component. Currently, it is found that improved humidity resistance for cold box formulation can be obtained by using the biphenyl component in amounts of just 0.5–2% by weight of a part one or part two component. It is also found that amounts of about 10% and up to 80% by weight of biphenyl component in a part one or part two component improves mold release properties of a finished composition containing the cured binder. Accordingly, the compounds of Formulae I and II can be used in amounts of about 0.5–80% by weight of a part one or part two component as an additive or as a substitute for a portion of the presently used solvents/plasticizers. As a practical consideration the amount of biphenyl component used may ultimately depend on balancing economic factors with specific benefits desired. The biphenyl compounds are less expensive than currently used plasticizers and more expensive than the currently used solvents.

The compounds of Formulae I and II may be used strictly as either a third part (or component) of a foundry binder system, or mixed with a sand composition prior to the inclusion of parts one and two of the binder system. The biphenyl compounds may also be added to foundry sand mixtures in conjunction with either parts one and two or both. The biphenyl component could be mixed with sand and sold or packaged as a mixture. For an improvement in release of the cold-box and no-bake systems, the preferred mode of application will be to incorporate the biphenyl component in amounts up to 80% of the part one and the part two components of the binder system. It is further anticipated that for an improvement in tensile strength performance, bench life performance, and humidity resistance of the cold-box system, the preferred mode of application will be to incorporate the biphenyl component in amounts greater than about 0.5% in the part one or part two components of the binder system.

The Phenolic Resole Resin

The phenol aldehyde resole resin has a phenol:aldehyde molar ratio from about 1:1.1 to about 1:3. A preferred mode of preparing the resole resin is to combine phenol with a source of aldehyde such as formaldehyde, acetaldehyde, furfural, benzaldehyde or paraformaldehyde under alkaline catalysis. During such reaction, the aldehyde is present in molar excess. It is preferred that the resole resin have a molar ratio of phenol to formaldehyde from about 1:1.1 to 1:2.5.

Any of the conventional phenolic resole resins or alkoxy modified resole resins may be employed as the phenolic resin with the present invention. Of the alkoxy modified resole resins, methoxy modified resole resins are preferred. However, the phenolic resole resin which is most preferred is the modified orthobenzylic ether-containing resole resin prepared by the reaction of a phenol and an aldehyde in the presence of an aliphatic hydroxy compound containing two or more hydroxy groups per molecule. In one preferred modification of the process, the reaction is also carried out in the presence of a monohydric alcohol.

Phenols suitable for preparing the modified orthobenzylic ether-containing phenolic resole resins are generally any of the phenols which may be utilized in the formation of phenolic resins, and include substituted phenols as well as unsubstituted phenol per se. The nature of the substituent can vary widely, and exemplary substituted phenols include alkyl-substituted phenols, aryl-substituted phenols, cycloakyl-substituted phenols, alkenyl-substituted phenols, alkoxy-substituted phenols, aryloxy-substituted phenols and halogen-substituted phenols. Specific suitable exemplary phenols include in addition to phenol per se, o-cresol, m-cresol, p-cresol, 3,5-xylenol, 3,4-xylenol, 3,4,5-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. A preferred phenolic compound is phenol itself.

The aldehyde employed in the formation of the modified phenolic resole resins can also vary widely. Suitable aldehydes include any of the aldehydes previously employed in the formation of phenolic resins, such as formaldehyde, acetaldehyde, propionaldehyde and benzaldehyde. In general, the aldehydes employed contain from 1 to 8 carbon atoms. The most preferred aldehyde is an aqueous solution of formaldehyde.

Metal ion catalysts useful in production of the modified phenolic resins include salts of the divalent ions of Mn, Zn, Cd, Mg, Co, Ni, Fe, Pb, Ca and Ba. Tetra alkoxy titanium compounds of the formula $Ti(OR)_4$ where R is an alkyl group containing from 3 to 8 carbon atoms, are also useful catalysts for this reaction. A preferred catalyst is zinc acetate. These catalysts give phenolic resole resins wherein the preponderance of the bridges joining the phenolic nuclei are ortho-benzylic ether bridges of the general formula $—CH_2(OCH_2)_n—$ where n is a small positive integer.

A molar excess of aldehyde per mole of phenol is used to make the modified resole resins. Preferably the molar ratio of phenol to aldehyde is in the range of from about 1:1.1 to about 1:2.2. The phenol and aldehyde are reacted in the presence of the divalent metal ion catalyst at pH below about 7. A convenient way to carry out the reaction is by heating the mixture under reflux conditions. Reflux, however, is not required.

To the reaction mixture is added an aliphatic hydroxy compound which contains two or more hydroxy groups per molecule. The hydroxy compound is added at a molar ratio of hydroxy compound to phenol of from about 0.001:1 to about 0.03:1. This hydroxy compound may be added to the phenol and aldehyde reaction mixture at any time when from 0% (i.e., at the start of the reaction) to when about 85% of the aldehyde has reacted. It is preferred to add the hydroxy compound to the reaction mixture when from about 50% to about 80% of the aldehyde has reacted.

Useful hydroxy compounds which contain two or more hydroxy groups per molecule are those having a hydroxyl number of from about 200 to about 1850. The hydroxyl number is determined by the standard acetic anhydride method and is expressed in terms of mg KOH/g of hydroxy compound. Suitable hydroxy compounds include ethylene glycol, propylene glycol, 1,3-propanediol, diethylene glycol, triethylene glycol, glycerol, sorbitol and polyether polyols having hydroxyl numbers greater than about 200. Glycerol is a particularly suitable hydroxy compound.

After the aliphatic hydroxy compound containing two or more hydroxy groups per molecule is added to the reaction mixture, heating is continued until from about 80% to about 98% of the aldehyde has reacted. Although the reaction can be carried out under reflux until about 98% of the aldehyde has reacted, prolonged heating is required and it is preferred to continue the heating only until about 80% to 90% of the aldehyde has reacted. At this point, the reaction mixture is heated under vacuum at a pressure of about 50 mm of Hg until the free formaldehyde in the mixture is less than about 1%. Preferably, the reaction is carried out at 95° C. until the free formaldehyde is less than about 0.1% by weight of the mixture. The catalyst may be precipitated from the reaction mixture before the vacuum heating step if desired. Citric acid may be used for this purpose. The modified phenolic resole may be "capped" to be an alkoxy modified phenolic resole resin. In capping, a hydroxy group is converted to an alkoxy group by conventional methods that would be apparent to one skilled in the art given the teachings of the present disclosure.

Isocyanates

The isocyanate component which can be employed in a binder according to this invention may vary widely and has a functionality of 2 or more. As defined herein, polyisocyanates includes isocyanates having such functionality of 2 or more, e.g., diisocyanates, triisocyanates, etc. Exemplary of the useful isocyanates are organic polyisocyanates such as tolylene-2,4-diisocyanate, tolylene-2,6-diisocyanate, and mixtures thereof, particularly crude mixtures thereof that are commercially available. Other typical polyisocyanates include methylene-bis-(4-phenyl isocyanate), n-hexyl diisocyanate, naphthalene-1,5-diisocyanate, cyclopentylene-1,3-diisocyanate, p-phenylene diisocyanate, tolylene-2,4,6-triisocyanate, and triphenylmethane-4,4',4"-triisocyanate. Higher isocyanates are provided by the liquid reaction products of (1) diisocyanates and (2) polyols or polyamines and the like. In addition, isothiocyanates and mixtures of isocyanates can be employed. Also contemplated are the many impure or crude polyisocyanates that are commercially available. Especially preferred for use in the invention are the polyaryl polyisocyanates having the following general Formula III:

III

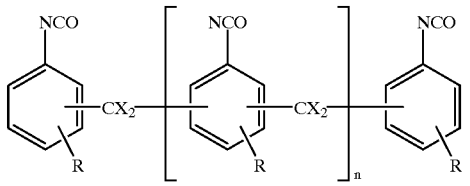

wherein R is selected from the group consisting of hydrogen, chlorine, bromine, and alkyl groups having 1 to 5 carbon atoms; X is selected from the group consisting of hydrogen, alkyl groups having 1 to 10 carbon atoms and phenyl; and n has an average value of generally about 0 to about 3. The preferred polyisocyanate may vary with the particular system in which the binder is employed.

Paraffinic Oils

The paraffinic oil may be any of a number of viscous pale to yellow conventional refined mineral oils. For example white mineral oils may be employed in the present invention. The paraffinic oil may be in the phenolic resin component, the isocyanate component, or both components. The binder may contain from about 0.1 to about 25 weight percent paraffinic oil. Preferably, the binder contains from about 0.5 to about 10 weight percent paraffinic oil, based on total weight of binder. The paraffinic oils typically are aromatic free and olefin free and have a viscosity at 25° C. of about 10 to about 100 centipoise, preferably about 10 to about 50 centipoise, as measured on a Brookfield viscometer, #2 spindle. The paraffinic oil may also have a refractive index at 25° C. of about 1.460 to about 1.475. An especially preferred paraffinic oil is SEMTOL 70, manufactured by Witco Chemical Co., New York, N.Y.

Epoxy Resin

The binder typically contains from about 0.1 to about 25 weight percent epoxy resin, preferably about 0.5 to about 5 weight percent. Epoxy resins are commercially available and prepared from either glycidyl materials such as the ethers, produced by the reaction of chlorohydrin with a phenol or alcohol, or epoxies, such as the product from the reaction of peracetic acid with a linear or cycloaliphatic olefin. The epoxy resin molecule is characterized by the reactive epoxy or ethoxline groups:

IV

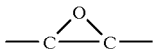

which serve as terminal linear polymerization points. Crosslinking or cure is accomplished through these groups or through hydroxyls or other groups present. The well-known epoxy resins are usually prepared by the base-catalyzed reaction between an epoxide, such as epichlorohydrin and a polyhydroxy compound, such as bisphenol A.

Preferably epoxy resins can be selected from glycidyl ethers made from bisphenol A and epichliorohydrin. These resins are available in liquid form having a typical viscosity of about 200 to about 20,000 centipoises, and an epoxide equivalent weight of about 170 to about 500 and weight average molecular weight of about 350 to about 4000. Typical epoxy resins include ARALDITE 6005 sold by Ciba-Geigy Corporation or EPN 1139 novolac-based epoxy resin such as a liquid epoxy novolac resin manufactured by Ciba-Geigy Corporation. A preferred epoxy resin is Dow DER 331 manufactured by Dow Chemical Company, Midland, Mich. However, solid epoxy resins (solid in the neat state) may be employed if they are soluble in the binder resin system and reactive.

In general, preferred bisphenol A-based epoxy resin for the present invention would have approximately the structure given in Formula V below. These types of resins are commercially available in a range of molecular weights, epoxy equivalents, and viscosities. Typically, these epoxy resins are reaction products of bisphenol A and epichlorohydrin as shown, for example, by Formula V:

V

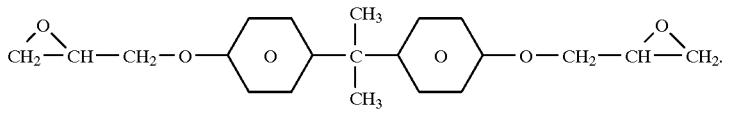

The reaction products polymerize to form resins having the following general Formula VI:

VI

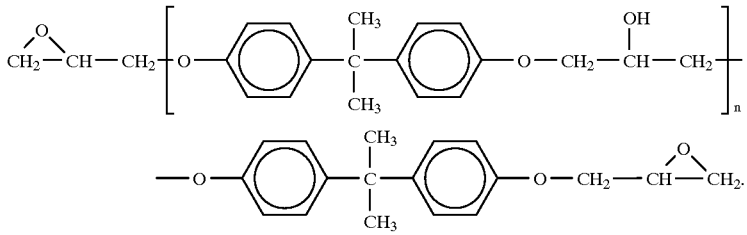

In Formula VI, n is the number of repeating units and may be from 0 to about 15. Although the preferred formulation employs the above type of epoxy, other epoxy resins are useful. These would include any epoxy resins that are at least di-functional and soluble in the resin system. The upper limit of functionality occurs where the epoxy is insoluble, or intractable, in the resin system. The resin system would include the base resin and the solvents and plasticizers the base resin is dissolved into. The two parameters, functionality and solubility, are key to the application for improved resistance to water-based coatings. If an epoxy resin is soluble in the resin system, and if it is "cross-linkable" (minimally di-functional), then the properties disclosed relative to resistance to water-based coatings would be attainable in varying degrees.

The epoxy resin is uncured when added to the binder resin systems of the present invention. The epoxy resin then cures during the curing of the urethane resin. The phenolic resins employed in the present invention are inherently reactive relative to epoxy resins. Epoxy resins may be cross-linked by various routes, and the resin systems presently disclosed provide several of these routes. Epoxy-epoxy polymerizations initiated by tertiary amines, for example, are well known mechanisms in the field of epoxy chemistry. Tertiary amines are the catalysts employed in both the cold box and no bake examples given in the present specification. Epoxy-hydroxyl polymerization may occur if properly catalyzed. Both organic and inorganic bases have been used as catalysts for epoxy-hydroxyl polymerization. A tertiary amine is one such catalyst. It should also be apparent to one skilled in the art that heat will aid the polymerizations discussed herein.

Coupling Agents and Additives

In the practice of this invention, additives normally utilized in foundry manufacturing processes can also be added to the compositions during the sand coating procedure. Such additives include materials such as iron oxide, clay, carbohydrates, potassium fluoroborates, wood flour and the like.

Other commonly employed additives can be optionally used in the binder compositions of this invention. Such additives include, for example, organo silanes which are known coupling agents. The use of such materials may enhance the adhesion of the binder to the aggregate material. Examples of useful coupling agents of this type include amino silanes, epoxy silanes, mercapto silanes, hydroxy silanes and ureido silanes.

Catalysts

As previously indicated hereinabove, the compositions of this invention can be cured by both the "cold-box" and "no-bake" processes. The compositions are cured by means of a suitable catalyst. While any suitable catalyst for catalyzing the reaction between the phenolic resin component and isocyanate component may be used, it is to be understood that when employing the "cold-box" process, the catalyst employed is generally a volatile catalyst. On the other hand, where the "no-bake" process is employed, a liquid catalyst is generally utilized. Moreover, no matter which process is utilized, that is, the "cold-box" or the "no-bake" process, at least enough catalyst is employed to cause substantially complete reaction of the polyhydroxy phenolic resin component and the isocyanate component.

Preferred exemplary catalysts employed when curing the compositions of this invention by the "cold-box" process are volatile basic catalysts, e.g., tertiary amine gases, which are passed through a core or mold generally along with an inert carrier, such as air or carbon dioxide. Exemplary volatile tertiary amine catalysts which result in a rapid cure at ambient temperature that may be employed in the practice of the present invention include trimethyl-amine, triethylamine and dimethylethylamine and the like.

On the other hand, when utilizing the compositions of this invention in the "no-bake" process, liquid tertiary amine catalysts are generally and preferably employed. Exemplary liquid tertiary amines which are basic in nature include those having a $pK_b$ value in a range of from about 4 to about I1. The $pK_b$ value is the negative logarithm of the dissociation constant of the base and is a well-known measure of the basicity of a basic material. The higher the number is, the weaker the base. Bases falling within the mentioned range are generally, organic compounds containing one or more nitrogen atoms. Preferred among such materials are heterocyclic compounds containing at least one nitrogen atom in the ring structure. Specific examples of bases which have a $pK_b$ value within the range mentioned include 4-alkylpyridines wherein the alkyl group has from 1 to 4 carbon atoms, isoquinoline, arylpyridines, such as phenyl pyridine, acridine, 2-methoxypyridine, pyridazines, 3-chloropyridine, and quinoline, N-methylimidazole, N-vinylimidazole, 4,4-dipyridine, phenylpropylpyridine, 1-methylbenzimidazole and 1,4-thiazine. Additional exemplary, suitable preferred catalysts include, but are not limited to, tertiary amine catalysts such as N,N-dimethylbenzylamine,triethylamine, tribenzylamine,N, N-dimethyl-,3-propanediamine, N,N-dimethylethanolamine and triethanolamine. It is to be understood that various metal organic compounds can also be utilized alone as catalysts or in combination with the previously mentioned catalyst. Examples of useful metal organic compounds which may be employed as added catalytic materials are cobalt naphthenate, cobalt octate, dibutyltin dilaurate, stannous octate and lead naphthenate and the like. When used in combinations, such catalytic materials, that is the metal organic compounds and the amine catalysts, may be employed in all proportions with each other.

It is further understood that when utilizing the compositions of this invention in the "no-bake" process, the amine catalysts, if desired, can be dissolved in suitable solvents such as, for example, the hydrocarbon solvents mentioned hereinabove. The liquid amine catalysts are generally employed in a range of from about 0.5% to about 15% by weight, based on the weight of the phenolic resin component present in a composition in accordance with the invention.

When employing a binder composition of this invention in the "no-bake" process, the curing time can be controlled by varying the amount of catalyst added. In general, as the amount of catalyst is increased, the cure time decreases. Furthermore, curing takes place at ambient temperature without the need for subjecting the compositions to heat, or gassing or the like. However, in usual foundry practice preheating of the sand is often employed to raise the temperature of the sand to accelerate the reactions and control temperature and thus, provide a substantially uniform operating temperature on a day-to-day basis. The sand is typically preheated to from about 30° F. up to as high as 120° F. and preferably up to about 75° F. to 100° F. However, such preheating is neither critical nor necessary in carrying out the practice of this invention.

Coating the Urethane-Containing Resin onto Foundry Sand

In general, the process for making foundry cores and molds in accordance with this invention comprises admixing aggregate material with at least a binding amount of the phenolic resin component. Preferably, the process for making foundry cores and molds in accordance with this invention comprises admixing aggregate material with at least a binding amount of the modified phenolic resole resin component. The phenolic resin is dissolved in sufficient solvent to reduce the viscosity of the phenolic resin component to below about 1000 centipoises. This solvent comprises hydrocarbon solvents, polar organic solvents and mixtures thereof. Then, an isocyanate component, having a functionality of two or more, is added and mixing is continued to uniformly coat the aggregate material with the phenolic resin and isocyanate components. As discussed above, either or both of the phenolic resole resin component and the isocyanate component contain paraffinic oil. The admixture is suitably manipulated, as for example, by distributing the same in a suitable core box or pattern. A sufficient amount of catalyst is added to substantially and completely catalyze the reaction between the components. The admixture is cured forming a shaped product.

There is no criticality in the order of mixing the constituents with the aggregate material. On the other hand, the catalyst should generally be added to the mixture as the last constituent of the composition so that premature reaction between the components does not take place. It is to be further understood that as a practical matter, the phenolic resin component can be stored separately and mixed with solvent just prior to use of or, if desirable, mixed with solvent and stored until ready to use. Such is also true with the isocyanate component. As a practical matter, the phenolic and isocyanate components should not be brought into contact with each other until ready to use to prevent any possible premature reaction between them. The components may be mixed with the aggregate material either simultaneously or one after the other in suitable mixing devices, such as mullers, continuous mixers, ribbon blenders and the like, while continuously stirring the admixture to insure uniform coating of aggregate particles.

When the admixture is to be cured according to "cold-box" procedures, the admixture after shaping as desired, is subjected to gassing with vapors of an amine catalyst. Sufficient catalyst is passed through the shaped admixture to provide substantially complete reaction between the components. The flow rate is dependent, of course, on the size of the shaped admixture as well as the amount of phenolic resin therein.

In contrast, however, when the admixture is to be cured according to "no-bake" procedures, the catalyst is generally added to the aggregate material with the phenolic and isocyanate components. The admixture is then shaped and simply permitted to cure until reaction between the components is substantially complete, thus forming a shaped product such as a foundry core or mold. On the other hand, the catalyst may also be admixed with either one of the components prior to coating of the aggregate material with the components.

Consequently, by so proceeding, with an admixture of foundry sand and a binding amount of the phenolic and isocyanate components with the catalyst, there is formed a foundry core or mold comprising foundry sand and a binding amount of a hinder composition comprising the reaction product of the phenolic and isocyanate components.

FIG. 1 shows coated particulate material 30 for use in a foundry. The material 30 comprises a sand particle 35 and a resin coating 40. The particle 35 on which the resin 40 is coated has a precoated size in the range of USA Testing Standard screen numbers from about 16 to about 270. Although the FIGURE shows the coating of resin 40 as completely covering the sand particle 35, the resin 40 may only partially cover a given particle 35.

The binder compositions of this invention may be employed by admixing the same with a wide variety of particulate materials, such as limestone, calcium silicate and gravel and the like, to bind the same, and then the admixture is manipulated in suitable fashion to form coherent shaped structures. However, they are particularly useful in the foundry art as binding compositions for foundry sand. Suitable foundry sands include silica sand, lake sand, zircon sand, chromite sand, olivine sand and the like. When so employed, the amount of binder and sand can vary widely and is not critical. On the other hand, at least a binding amount of the binder composition should be present to coat substantially, completely and uniformly all of the sand particles and to provide a uniform admixture of the sand and binder. Thus, sufficient binder is present so that when the admixture is conveniently shaped as desired and cured, there is provided a strong, uniform, shaped article which is substantially uniformly cured throughout, thus minimizing breakage and warpage during handling of the shaped article, such as, for example, sand molds or cores, so made. In this regard, the binder may be present in a moldable composition, in accordance with this invention, in a range of from about 0.4% to about 6.0% by weight based on the total weight of the composition.

As objective evidence of the properties of composition of the invention, the following non-limiting examples, experiments, and data are presented. All percentages expressed in the Examples of the invention and comparisons are by weight unless otherwise specified.

EXAMPLES 1–2 AND COMPARATIVE EXAMPLES 1–2 OF COLD BOX FORMULATIONS

The bound multi-component additives, prepared according to this invention, were tested for use in foundry core and mold making applications. The process of core and mold making for the foundry industry is well known. In one method, resin binders are mixed with aggregate and the resulting mixture is cured into a hard durable shape. The methold used to make cores for testing, as described in the following Examples 1–2 and Comparative Examples 1–2, is the "cold box" phenolic urethane process. In this process, the binder system consists of two parts, namely, a part one phenolic polyol resin and a part two polymeric isocyanate resin. These two parts are mixed with foundry aggregate and the resulting mixture is blown into a core box that has the required shape. A gaseous tertiary amine catalyst is then passed through the blown shape and the part one and part two components react to form a hard durable urethane.

For these examples, about 6000 grams of silica sand (lake sand) were added to a KITCHEN AID mixer. The mixer was started and either a bound multi-component additive was mixed into the sand, or the unbound individual additive components were mixed into the sand. A part one resin and part two resin were then mixed into the sand/additive blend as discussed below.

To a depression in the sand, on one side of the mixing bowl was added approximately 17.2 g of a Solution I containing a modified phenolic resin as disclosed in U.S. Pat. No. 5,189,079 incorporated herein by reference, and having the composition listed in Table 2. This resin is a phenolic resole resin component wherein the preponderance of the bridges joining the phenolic nuclei are ortho-ortho benzylic ether bridges and which has covalently bound into the resin an aliphatic hydroxy compound which contains two or more hydroxy groups per molecule and has a hydroxyl number of from about 200 to about 1850, the molar ratio of the hydroxy compound to phenol being from about 0.001:1 to about 0.03:1. The resin was prepared by the reaction of a phenol, an aldehyde and an aliphatic hydroxy compound containing two or more hydroxy groups per molecule.

This foundry mix was blown into a core box using a Redford CBT-1 core blower. Cores were blown at 50 psi air pressure, gassed for three seconds with triethylamine, then purged with air at 30 psi pressure for five seconds. Cores thus prepared, formed American Foundrymen's Society 1-inch "dog-bone" briquettes.

Examples 1 and 2 employed epoxy resins in combination with paraffinic oils according to the formulae presented in Tables 2 and 3. These formulae represent modified part one and part two resins. Thus, for Example 1, dog bones were made of silica sand bound by a first mixture of Solution I and Solution II. For Example 2, dog bones were made of silica sand bound by a second mixture of Solution I and Solution III. The compositions of Solutions I, II and III are listed in Tables 2 and 3.

For Comparative Examples 1 and 2, dog bones were made of silica sand bound by conventional urethane cold box systems. Comparative Example 1 employed SIGMA CURE 7110/7611 manufactured by Borden, Inc./North American Resins, Louisville, Ky. Comparative Example 2 employed ACME FLOW 2057 CM manufactured by Borden, Inc./North American Resins.

These cores were subjected to tensile testing at various times after the cure time. Cores thus made will increase in tensile strength, up to a maximum value, as they age beyond the time of cure. Data collected as a function of core age comprises results referred to as tensile build. An uncured portion of the sand/additive/binder mixture was allowed to stand exposed to the laboratory environment for a period of time. At various times after mixing, cores were made from the mixture. As the mixture ages, tensile strengths of cores made from the mixture will decrease below the values collected for a fresh mix. Sand/additive conditions such as an elevated alkalinity or an elevated pH will accelerate the rate of tensile strength degradation as a function of mix age. Data collected as a function of mix age comprises results referred to as bench life.

Tensile strengths of the cores prepared as noted above were determined using a Thwing-Albert Tensile Tester (Philadelphia, Pa.). This device consists of jaws that accommodate the ends of the "dog-bone". A load is then applied to each end of a "dog-bone" as the jaws are moved away from each other. The application of an increasing load continues until the "dog-bone" breaks. The load at this point is termed the tensile strength, and it has units of psi (pounds per square inch).

TABLE 2

Phenolic Resin Solution I

| Component | Weight % |
|---|---|
| Phenolic Resin[1] | 58.1 |
| Dioctyl Adipate[2] | 8.7 |
| Arormatic Hydrocarbon[3] | 21.4 |
| Dibasic acid Ester[4] | 8.7 |
| Alkylbiphenyls[5] | 1.4 |
| Oleic Acid[6] | 0.5 |
| Paraffinic Oil[7] | 0.9 |
| Silane[8] | 0.3 |

[1]Resole resin
[2]Plasticizer which also imparts some water resistance
[3]Solvent, SURE-SOL 205, $C_{10}$ aromatic isomers, Koch Chemical Co., Corpus Christi, Texas
[4]DBE-9 available from DuPont, Wilmington, Delaware which contains approximately 73% dimethylglutarate, 25% dimethylsuccinate, and 1.5% dimethyladipate
[5]Mixture of di- and tri- substituted biphenyl compounds
[6]Plasticizer
[7]SEMTOL 70, Witco Chemical Co., New York, NY
[8]Coupling Agent

TABLE 3

Isocyanate Solution

| Component | Weight % | |
|---|---|---|
| | Solution II | Solution III |
| Isocyanate[9] | 75.0 | 75.0 |
| Aromatic Hydrocarbons[10] | 14.6 | 16.6 |
| Alkylbiphenyls[11] | 2.0 | 2.0 |
| Paraffinic Oil[12] | 4.0 | 2.0 |
| Epoxy Resin[13] | 1.0 | 1.0 |

TABLE 3-continued

| Isocyanate Solution | Weight % | |
|---|---|---|
| Component | Solution II | Solution III |
| Long-chain Ester[14] | 3.0 | 3.0 |
| Organic Acid[15] | 0.2 | 0.2 |
| Silane[16] | 0.2 | 0.2 |

[9]methylene biphenyl diisocyanate
[10]Solvent, SURE-SOL 205, $C_{10}$ aromatic isomers Koch Chemical Co., Corpus Christi, Texas
[11]Mixture of di- and tri- substituted biphenyl compounds
[12]SEMTOL 70, Witco Chemical Co., New York, NY
[13]DOW DER 331, Dow Chemical Co., Midland, MI
[14]Glycerol trioleate
[15]Phenyl phosphoric dichloride
[16]coupling agent The formulae made of ingredients reported in Tables 2 and 3 were tested against the conventional urethane cold box systems of Comparative Examples 1 and 2 that did not contain epoxy resins and paraffinic oils. However, Comparative Example 2 employed a part two resin system which contained 7.5% of the same long-chain ester reported in Table 3 above. Tables 4 through 7 illustrate the comparison of the resin systems of the present invention and the conventional systems.

TABLE 4

| Tensile Build Comparison | Tensile Strength, psi | | |
|---|---|---|---|
| Age of Core Example | 1 | 2 | Comparative Example 1 |
| 1 minute | 338 | 311 | 274 |
| 1 hour | 428 | 422 | 366 |
| 24 hours | 467 | 453 | 412 |
| 24 hours, 90% relative humidity | 334 | 346 | 333 |
| 24 hours, 100% relative humidity | 119 | 133 | 244 |

Notes:
1.65% Binder (based on sand)
55/45 part 1 to part 2 ratio
silica sand

TABLE 5

| Bench Life Comparison | Tensile Strength, psi, 1 Minute Core Age | | |
|---|---|---|---|
| Age of Sand mix, hours Example | 1 | 2 | Comparative Example 1 |
| 0 | 338 | 311 | 274 |
| 1 | 273 | 266 | 255 |
| 2 | 252 | 245 | 240 |
| 3 | 214 | 234 | 224 |

Notes:
1.65% Binder (based on sand)
55/45 part 1 to part 2 ratio
silica sand

TABLE 6

| Effect of Water-Based Coatings | Tensile Strength, psi | | |
|---|---|---|---|
| Age of Core Example | 1 | 2 | Comparative Example 1 |
| 1 minute | 223 | 214 | 78 |
| 5 minutes | 299 | 271 | 137 |
| 30 minutes | 453 | 444 | 226 |

Notes:
1.65% Binder (based on sand)
55/45 part 1 to part 2 ratio
silica sand
Cores dipped in SATIN KOTE 40, manufactured by Borden, North American Resins, Oak Creek, Wisconsin. SATIN KOTE 40 is a water-based refractory coating used principally in the foundry industry. This coating is a suspension of silica and other refractory materials in water.
Baked at 400° F. for 10 minutes

TABLE 7

| Effect of Water-Based Coatings | Tensile Strength, psi | |
|---|---|---|
| Age of Core Example | 1 | Comparative Example 2 |
| 1 minute | 122 | 64 |
| 5 minutes | 206 | 142 |
| 30 minutes | 276 | 232 |
| 24 hours | 329 | 254 |

Notes:
1.3% Binder (based on sand)
55/45 part 1 to part 2 ratio
silica sand
Cores dipped in PX-4 water-based refractory coating which contains a refractory graphite, manufactured by REFCOTEC, Orville, Ohio.
Baked at 315° F. for 25 minutes Based on the results depicted in Table 4, the invention has the potential of significantly increasing initial tensile strengths. This can be a significant advantage in practice, because it creates the potential for lower resin use levels. There does appear to be a negative effect on tensile strengths developed at 24 hours of core age under 100% relative humidity. This does not outweigh the advantage created in the high initial strength.

In bench life, shown in Table 5, the invention offers initial tensile strengths that are initially higher than, and subsequently higher or comparable to, the conventional system. The initial rate of tensile loss, through one hour sand mix age is greater for the invention. However, for sand mix age of one hour through three hours the invention has approximately the same rate of tensile strength loss as the conventional system.

Tables 6 and 7 illustrate the advantage of the invention in terms of resistance to water-based coatings. For both sets of data, cores were dipped in a water-based coating and then baked to dry the cores. For the data of Table 6, cores were baked for 25 minutes at 315° F. For the data of Table 7, cores were baked for 10 minutes at 315° F. The cores were then allowed to cool, exposed to ambient conditions, and were tested for strength at the times indicated on the graphs. Table 7 further illustrates that the advantages realized with the invention are separable from any effects due to the use of long-chain esters.

EXAMPLE 3 AND COMPARATIVE EXAMPLE 3 OF NO-BAKE FORMULATIONS

To the KITCHEN AID mixer employed in Examples 1 and 2 was added about 3000 grams of round grain silica sand. To a depression in the sand, on one side of the mixing bowl of the mixer was added approximately 17.2 g of a part one Solution containing conventional part 1—phenolic resole resin SIGMA SET 6100 and manufactured by Borden, Inc./North American Resins, Louisville, Ky.

To 17.2 grams of the part one Solution of SIGMA SET 6100 resin was added 0.9 ml of SIGMA SET 6720 liquid tertiary amine catalyst solution. Then approximately 14.1 grams of a part two methylene biphenyl diisocyanate solution was added to a depression in the sand opposite that containing the part one and catalyst components. The part two-isocyanate solution had the composition listed in Table 8.

TABLE 8

Isocyanate Solution IV

| Component | Weight % |
|---|---|
| Isocyanate[17] | 71 |
| Aromatic Hydrocarbons[10] | 25.5 |
| Plasticizer[18] | 2 |
| Paraffinic Oil[12] | 0.5 |
| Epoxy Resin[13] | 1 |

[10]SURE-SOL 150 ND, Koch Chemical Co., Corpus Christi, Texas
[12]SEMTOL 70, Witco Chemical Co., New York, NY
[13]DOW DER 331, Dow Chemical Co., Midland MI
[17]M2OS - Polymeric methylene diisocyanate, BASF, Parsippany, NJ
[18]TXIB, plasticizer - 2,2,4-trimethyl-1,3-pentanediol diisobutyrate, manufactured by Eastman Chemical Products, Inc., Eastman Kodak Company, Kingsport, TN The sand was discharged from the mixer after mixing the sand and components for one minute. This results in a mixture of sand and binder containing 1.25 weight percent binder. The binder being 55/45 weight ratio of part 1/part 2 components. The resin-sand mixture was used immediately to form standard American Foundry Society 1-inch dog-bone tensile briquettes using a Dietert 12 gang core-box. A batch of dog-bone briquettes or cores were cured at room temperature and cores were broken at 12 minutes after being removed from the core-box. This first batch was not coated with water-based coating.

Comparative Example 3 employs SIGMA SET 6100/6500/6720 resin system manufactured by Borden, Inc./North American Resins, Louisville, Ky. Thus, Comparative Example 3 employs SIGMA SET 6100 part one phenolic resin, SIGMA SET 6270 liquid tertiary amine catalyst, and SIGMA SET 6500 part two isocyanate resin. The resin system of Comparative Example 3 was mixed to have 55/45 weight ratio of part 1/part 2 solutions. Also, the resin system of Comparative Example 3 was mixed with round grain silica sand to form a mixture that was 1.25 weight percent binder. The sand was discharged from the mixer after mixing the sand and resin system components for one minute. This resin-sand mixture was immediately used to form standard American Foundry Society 1-inch dog-bone tensile briquettes as described above.

A number of the briquettes made for Example 3 and Comparative Example 3 were not coated with water based coating. A tensile strength comparison was performed of these briquettes. The comparison was made of these briquettes (cores) tested at 12 minutes after being stripped from the dog-bone molds. The comparison results are listed in Table 9:

TABLE 9

Uncoated Briquettes - Tensile Strength Comparison

| Example | Tensile Strength (psi) |
|---|---|
| Comparative Example 3 | 174 |
| Example 3 | 177 |

Another portion of the above-described briquettes were coated with a water-based coating and then baked in an oven at 315° F. for about 15 minutes. The tensile strengths of these briquettes were then measured at one minute out of the oven. Thus, the briquettes had a temperature of about 250° F. when broken by the tensile tests. The measured tensile strengths are listed in Table 10.

TABLE 10

Coated Briquettes - Tensile Strength Comparison

| Example | Tensile Strength (psi) |
|---|---|
| Comparative Example 3 | 74 |
| Example 3 | 112 |

The results of this example show that the binders of the present invention achieve a significantly higher tensile strength for briquettes (cores) having water based coatings.

EXAMPLE 4 AND COMPARATIVE EXAMPLE 4 OF COLD BOX FORMULATIONS

For Example 4, the procedure of Example 1 was repeated, however the resin was made of the part one-phenolic resin Solution I of Table 2 and a part two-isocyanate Solution V of Table 11.

TABLE 11

Isocyanate Solution V

| Component | Weight % |
|---|---|
| Isocyanate[9] | 75 |
| Aromatic Hydrocarbons[10] | 14.2 |
| Alkylbiphenyls[11] | 2.0 |
| Paraffinic Oil[12] | 4.0 |
| Epoxy Resin[13] | 1.0 |
| Long-chain Ester[14] | 3.0 |
| Organic Acid[15] | 0.6 |
| Silane[16] | 0.2 |

[9]methylene biphenyl diisocyanate
[10]SURE-SOL 205, Koch Chemical Co., Corpus Christi, Texas
[11]Mixture of di- and tri- substituted biphenyl compounds
[12]SEMTOL 70, Witco Chemicai Co., New York, NY
[13]DOW DER 331, Dow Chemical Co., Midland, MI,
[14]Glycerol trioleate
[15]Phenyl phosphoric dichloride
[16]coupling agent For Comparative Example 4, lake sand was mixed with a binder made of ACME FLOW 2012/2052 phenolic part 1/isocyanate part 2 resin system, available from Borden, Inc., North American Resins, Louisville, Ky.

The above system of Example 4 was tested against the system of Comparative Example 4. Testing was done as previously described. Sand tests were run on a lake sand, at a 1.6% binder level based on solids, and a part 1 to part 2 ratio of 52/48. Tables 12, 13 and 14, respectively, compare the tensile build, bench life, and effect of the application of a water-based coating. Cores were dipped in the water based coating five minutes after being gassed, and then were dried in an oven at 400° F. for 10 minutes, prior to testing.

TABLE 12

Tensile Build Comparison

| Age of Core | Tensile Build (psi) Example 4 | Comparative Example 4 |
|---|---|---|
| 1 minute | 273 | 255 |
| 1 hour | 299 | 278 |
| 24 hours | 334 | 324 |
| 24 hours 90% relative humidity | 235 | 212 |
| 24 hours 100% relative humidity | 141 | 128 |

TABLE 13

Bench Life Comparison

| Time (hours) | Bench Life (tensile strength, psi, 1 minute core age) Example 4 | Comparative Example 4 |
|---|---|---|
| 0 | 273 | 255 |
| 1 | 231 | 217 |
| 2 | 179 | 168 |
| 3 | 170 | 150 |

TABLE 14

Tensile Build Comparison
Effect of SATIN KOTE 40[14] Cores
Baked at 400° F. for 10 Minutes

| Time (Minutes) | Tensile Build (tensile strength, psi) Example 4 | Comparative Example 4 |
|---|---|---|
| 1 | 227 | 131 |
| 30 | 170 | 109 |

[1]Manufactured by Borden, Inc., North American Resins, Oak Creek, WI. SATIN KOTE 40 is a water-based refractory coating used principally in the foundry industry. This coating is a suspension of silica and other refractory materials in water.

Thus, it is apparent that there has been provided, in accordance with the present invention, a method for improving characteristics of a foundry binder composition that fully satisfies the objects, aims and advantages set forth above.

While the invention has been described in conjunction with specific embodiments thereof, it is evident that many alternatives, modifications and variations will be apparent to those skilled in the art in light of the foregoing description. Accordingly, it is intended that the present invention is not limited by the foregoing description. Rather, it includes all such alternatives, modifications and variations as set forth within the spirit and scope of the appended claims.

What is claimed is:

1. A method for producing a urethane foundry binder which resists water-based coatings comprising the steps of: mixing together a polyhydroxy phenolic resole resin, at least one polyisocyanate, an epoxy resin having an epoxy functionality of at least two and soluble in the mixture, and a from about 0.1 to about 25 weight percent of paraffinic oil to form a mixture.

2. The method of claim 1, wherein the epoxy resin has a viscosity of about 200 to about 20,000 centipoise and an epoxide equivalent weight of about 170 to about 500.

3. The method of claim 1, wherein the epoxy resin has a weight average molecular weight of about 350 to about 4000.

4. The method of claim 1, wherein the epoxy resin is a solid epoxy resin in its neat state.

5. The method of claim 1, wherein the epoxy resin is a diglycidyl ether made from bisphenol A and epichlorohydrin.

6. The method of claim 1, wherein the paraffinic oil has a viscosity at 25° C. of about 10 to about 100 centipoise.

7. The method of claim 6, wherein the paraffinic oil has a viscosity at 25° C. of about 10 to about 50 centipoise.

8. The method of claim 1, further comprising:

including in the mixture a hot strength improving amount of at least one biphenyl compound of the following Formula I:

I

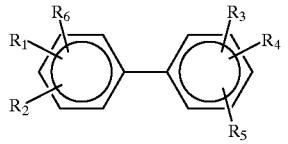

wherein $R_1$, $R_2$, $R_3$, $R_4$, $R_5$ and $R_6$, which may be the same or different, are selected from the group consisting of H and $C_1$–$C_6$ branched and unbranched alkyl and alkenyl substituents, with the proviso that when $R_1$–$R_6$ are each hydrogen and the binder compatible amount of such a compound is present in amounts of less than 1% by weight of a member of the group consisting of the polyhydroxyl phenolic resole component and the polyisocyanate, such a compound is used in combination with at least one other of said biphenyl compounds, and molding the mixture and curing the mixture in the presence of a curing catalyst.

9. The method of claim 1, wherein the epoxy resin is mixed with the polyhydroxy phenolic resole resole resin prior to mixing the polyhydroxy phenolic resin with the polyisocyanate.

10. The method of claim 1, wherein the epoxy resin is mixed with the polyisocyanate prior to mixing the polyisocyanate with the polyhydroxy phenolic resole resin.

* * * * *